US008494404B2

(12) United States Patent
Takagi et al.

(10) Patent No.: US 8,494,404 B2
(45) Date of Patent: Jul. 23, 2013

(54) IMAGE FORMING APPARATUS, IMAGE FORMING METHOD, CLEANING APPARATUS, AND CLEANING METHOD

(75) Inventors: Masahiro Takagi, Kanagawa (JP); Tetsuya Taguchi, Kanagawa (JP); Hirokazu Hamano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 183 days.

(21) Appl. No.: 12/876,492

(22) Filed: Sep. 7, 2010

(65) Prior Publication Data

US 2011/0236052 A1 Sep. 29, 2011

(30) Foreign Application Priority Data

Mar. 26, 2010 (JP) ..... 2010-072055

(51) Int. Cl.
*G03G 15/02* (2006.01)

(52) U.S. Cl.
USPC ..... 399/100; 399/357

(58) Field of Classification Search
USPC ..... 399/100, 357
See application file for complete search history.

(56) References Cited

U.S. PATENT DOCUMENTS

| | | | | |
|---|---|---|---|---|
| 3,916,426 | A * | 10/1975 | Bown | 396/614 |
| 4,089,683 | A * | 5/1978 | Knieser | 430/117.3 |
| 2006/0115292 | A1* | 6/2006 | Sampe et al. | 399/100 |
| 2006/0165431 | A1* | 7/2006 | Yanagida et al. | 399/100 |
| 2008/0019729 | A1* | 1/2008 | Hoshio et al. | 399/100 |
| 2008/0025753 | A1* | 1/2008 | Yamamoto et al. | 399/100 |
| 2008/0226335 | A1* | 9/2008 | Van Sas et al. | 399/101 |
| 2009/0003898 | A1* | 1/2009 | Kayahara et al. | 399/327 |

FOREIGN PATENT DOCUMENTS

| | | |
|---|---|---|
| JP | A-2007-078838 | 3/2007 |
| JP | A-2007-121543 | 5/2007 |
| JP | A-2007-241106 | 9/2007 |
| JP | A-2008-145566 | 6/2008 |
| JP | A-2008-304729 | 12/2008 |
| JP | A-2009-156995 | 7/2009 |

* cited by examiner

*Primary Examiner* — G. M. Hyder
(74) *Attorney, Agent, or Firm* — Oliff & Berridge, PLC

(57) ABSTRACT

An image forming apparatus includes a member to be cleaned and a cleaning roller driven by contact with the member to be cleaned, and the apparatus is configured such that abrasive grains and at least one of a release agent and a solid lubricant are supplied to the member to be cleaned and that the supplied abrasive grains and the supplied at least one of a release agent and a solid lubricant move on a surface of the member to be cleaned in an axial direction of the cleaning roller.

15 Claims, 3 Drawing Sheets

IMAGE FORMING APPARATUS, IMAGE FORMING METHOD, CLEANING APPARATUS, AND CLEANING METHOD

CROSS-REFERENCE TO RELATED APPLICATIONS

This application is based on and claims priority under 35 USC 119 from Japanese Patent Application No. 2010-072055 filed on Mar. 26, 2010.

BACKGROUND

1. Technical Field

This invention relates to an image forming apparatus, an image forming method, a cleaning apparatus, and a cleaning method.

2. Related Art

Conventional electrophotographic image forming apparatus, including copiers and printers, have mostly used a charger utilizing a corona discharge phenomenon, such as a scorotron. Because the chargers using a corona discharge phenomenon generate ozone and nitrogen oxides, they have recently been predominated by contact type chargers having a conductive charging roller in direct contact with an image holding member called a photoreceptor to charge the surface of the photoreceptor. Contact type chargers not only greatly reduce ozone and nitrogen oxide generation but achieve good power efficiency.

Since the contact type charger has its charging roller always in contact with a photoreceptor, the charging roller is liable to allow extraneous materials to adhere to its surface. Extraneous matter sticking to the charging roller causes unevenness of surface resistivity, which results in variation of charge.

A charging roller tends to be unevenly contaminated in the form of a streak, a band, or a spot. Causes of such uneven contamination include extreme imbalance of image density and partial damage or loss of resilience of an upstream cleaning member, which allows toner to leak, as well as entrance of foreign matter. When a voltage is applied to such a locally contaminated charging roller, there will be a region with a relatively low potential compared to the potential of the non-contaminated area. This results in output image defects, such as a color streak, a zonal fog, density unevenness, and a color spot.

SUMMARY

According to an aspect of the invention, there is provided an image forming apparatus including a member to be cleaned and a cleaning roller driven by the contact with the member to be cleaned, the apparatus being configured such that abrasive grains and at least one of a release agent and a solid lubricant are supplied to the member to be cleaned and that the supplied abrasive grains and release agent and/or solid lubricant move on the surface of the member to be cleaned in the axial direction of the cleaning roller.

BRIEF DESCRIPTION OF THE DRAWINGS

Exemplary embodiments of the present invention will be described in detail based on the following figures, wherein.

[Description of reference numerals and symbols]

| | |
|---|---|
| 10: | image forming apparatus |
| 11 | (inclusive of 11Y, 11M, 11C, and 11K): image forming stations |
| 12 | (inclusive of 12Y, 12M, 12C, and 12K): photoreceptor drums |
| 13 | (inclusive of 13Y, 13M, 13C, and 13K): exposure devices |
| 14 | (inclusive of 14Y, 14M, 14C, and 14K): charging rollers (contact type chargers) |
| 14A: | shaft |
| 14B: | charging layer |
| 15 | (inclusive of 15Y, 15M, 15C, and 15K): developing devices |
| 16 | (inclusive of 16Y, 16M, 16C, and 16K): developing rollers |
| 18 | (inclusive of 18Y, 18M, 18C, and 18K): first transfer rollers |
| 20 | (inclusive of 20Y, 20M, 20C, and 20K): cleaning blades |
| 30: | intermediate transfer belt |
| 32: | driving roller |
| 33: | tension roller |
| 34: | second transfer backup roller |
| 36: | second transfer roller |
| 38: | intermediate transfer belt cleaner |
| 40: | paper path |
| 42: | paper feed tray |
| 44: | feed roller |
| 46: | retard roller |
| 50: | fixing unit |
| 52: | heat roller |
| 54: | pressure roller |
| 56: | discharge roller |
| 100: | cleaning roller |
| 100A: | shaft |
| 100B: | elastic layer |
| 101: | contact area |
| P: | paper |
| T1: | first transfer nip |
| T2: | second transfer nip |

DETAILED DESCRIPTION

The image forming apparatus according to the first aspect of the invention includes a member to be cleaned and a cleaning roller driven by the contact with the member to be cleaned. The apparatus is configured such that abrasive grains and at least one of a release agent and a solid lubricant are supplied to the member to be cleaned and that the supplied abrasive grains and release agent and/or solid lubricant move on the surface of the member to be cleaned in the axial direction of the cleaning roller.

The image forming apparatus of the invention will be described in greater detail with reference to the accompanying drawing. Elements or members identified with the same numerals and/or alphabetical designations in the following description are identical.

The member to be cleaned according to the invention is not particularly limited and may be any member of the image forming apparatus that needs cleaning, such as a charging roller, an image holding member also called a photoreceptor, an intermediate transfer member, a first or second transfer roller, or a fixing member. The member to be cleaned may have any shape including not only a cylinder but also a belt, like a photoreceptor belt, a charging belt, an (intermediate) transfer belt, or a fixing belt.

In a preferred embodiment, the member to be cleaned is a charging roller. While the description to follow will generally be confined to the embodiment in which the member to be cleaned is a charging roller, the same applies to otherwise configured embodiments.

Figure 1:
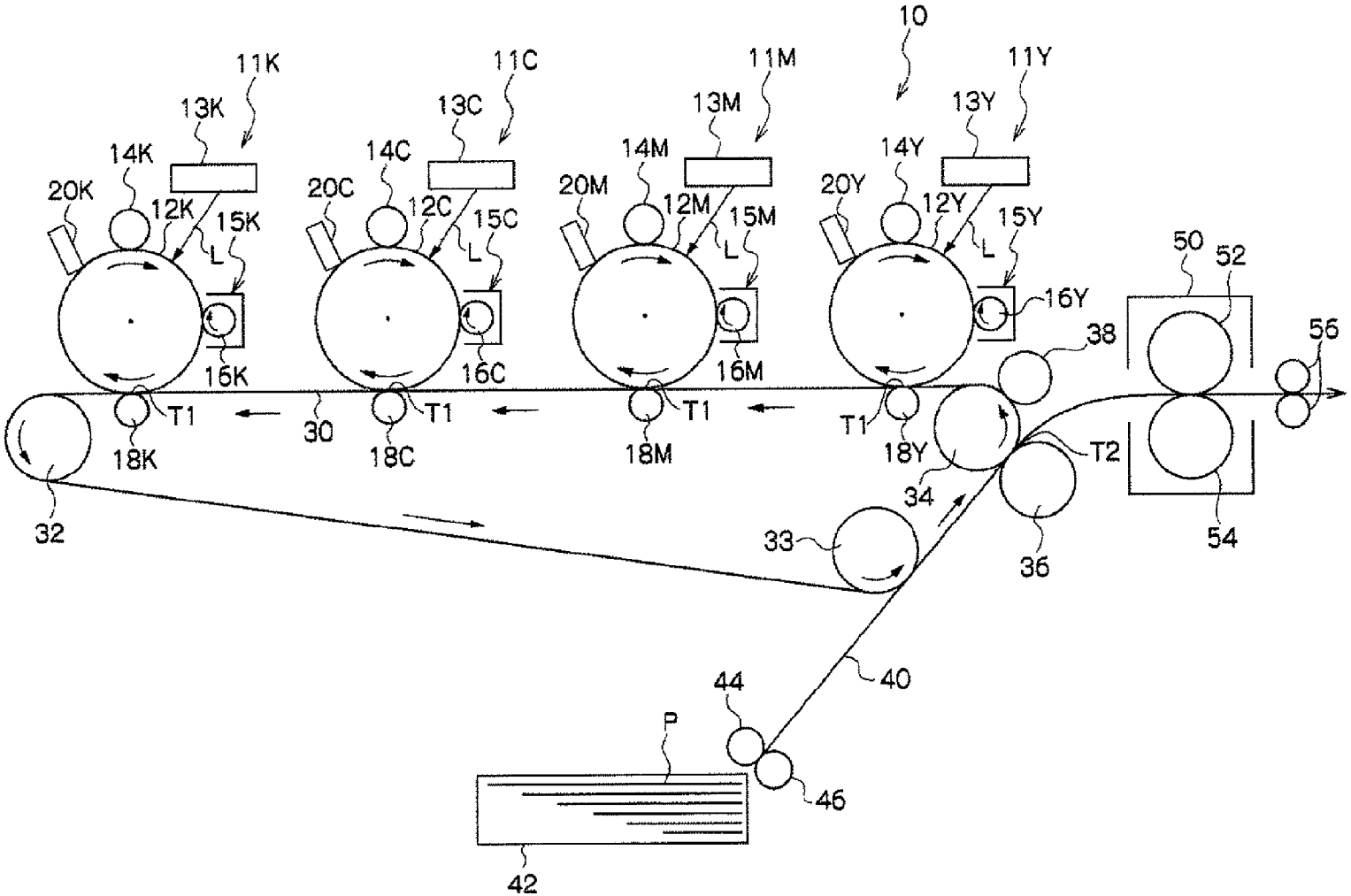
FIG. 1 schematically illustrates an embodiment of the image forming apparatus according to the invention.

An image forming apparatus 10 according to the present embodiment is illustrated in FIG. 1. The apparatus 10 is a four-color tandem engine copier in which, as shown, image forming stations 11Y, 11M, 110, and 11K forming yellow (Y), magenta (M), cyan (C), and black (K) toner images, respectively, are arranged in series along the moving direction of an intermediate transfer belt 30.

The image forming stations 11Y, 11M, 11C, and 11K (indiscriminately referred to as image forming stations 11) include photoreceptor drums 12Y, 12M, 120, and 12K (indiscriminately referred to as photoreceptor drums 12), respectively, as image holding members. Each photoreceptor drum 12 may be an electrically conductive cylinder covered with a photoreceptor layer made of, e.g., an organic photoconductor. The photoreceptor drum 12 is rotatably driven by an unshown motor in the direction of arrows, i.e., clockwise direction at a predetermined speed.

The image forming stations 11 also include charging rollers (contact type chargers) 14Y, 14M, 140, and 14K (indiscriminately referred to as charging rollers 14) almost right above the photoreceptors 12Y, 12M, 12C, and 12K, respectively. Exposure devices 13Y, 13M, 130, and 13K (indiscriminately referred to as exposure devices 13) that apply a laser beam L to the surface of the photoreceptor drums 12 to form respective latent images are placed above the respective photoreceptor drums 12.

The image forming stations 11 also include developing devices 15Y, 15M, 15C, and 15K (indiscriminately referred to as developing devices 15), positioned adjacent the right side of the respective photoreceptor drums 12. The developing devices 15 include respective development rollers 16 (i.e., 16Y, 16M, 16C, and 16K) that develop or visualize the respective latent images on the respective photoreceptor drums 12 with the respective color toners (i.e., Y, M, C, and K) to form respective toner images.

Placed to face the lower side of the photoreceptor drums 12Y, 12M, 12C, and 12K are first transfer rollers 18Y, 18M, 180, and 18K (indiscriminately referred to as first transfer rollers 18), respectively, to which a positive first transfer bias is applied. An endless intermediate transfer belt 30 on which the toner images are to be sequentially transferred travels between the photoreceptor drums 12 and the facing respective first transfer rollers 18 to provide first transfer nips T1 between the photoreceptor drums 12 and the intermediate transfer belt 30. A positive bias for first transfer is applied to the first transfer rollers 18.

Placed adjacent to the upper left side of the photoreceptor drums 12 are cleaning devices for removing residual toner from the respective photoreceptor drums 12 after the first transfer. The cleaning devices have cleaning blades 20 (i.e., 20Y, 20M, 20C, and 20K, respectively) as cleaning members that are positioned in contact with the respective photoreceptor drums 12 under pressure and rotate in a direction opposite to the rotation direction of the respective photoreceptor drums 12 to scrape residual toner from the surface of the photoreceptor drums 12. The cleaning member for removing residual toner is not limited to a blade and may be a roller, a brush, a belt, waste cloth, or the like.

The intermediate transfer belt 30 is placed over a driving roller 32, a tension roller 33, and a second transfer backup roller 34 and travels synchronously with the rotation of the photoreceptor drums 12 in the rotation direction of the photoreceptor drums 12. The image forming stations 11Y, 11M, 11C, and 11K are arranged in tandem in the travelling direction of the intermediate transfer belt 30 in the order described. In this way, the toner images on the photoreceptor drums 12 are sequentially deposited in superimposed registration on the intermediate transfer belt 30 at the respective first transfer nips T1 in the order of yellow, magenta, cyan, and black. The intermediate transfer belt 30 having the resulting multi-colored toner image further travels toward the position of a second transfer nip T2 (a second transfer roller 36) described below.

Placed on the right hand side of the intermediate transfer belt 30 is a second transfer roller 36 with a paper path 40 therebetween to provide a second transfer nip T2. A negative second transfer bias is applied to the second transfer roller 36, whereby the second transfer roller 36 transfers the multi-colored toner image on the intermediate transfer belt 30 onto a sheet of paper P while being assisted by the second transfer backup roller 34. To the upper right of the second transfer backup roller 34, which rotatably supports the intermediate transfer belt 30, is set an intermediate transfer belt cleaner 38 which removes residual toner remaining on the intermediate transfer belt 30.

Disposed below the intermediate transfer belt 30A is a paper feed tray 42 containing paper P. Close to the right hand side of the paper feed tray 42 are set a feed roller 44 that feeds paper P from the paper feed tray 42 to the paper path 40 and a retard roller 46 that allows only the top sheet of the paper stack to go through the nip with the feed roller 44.

A fixing unit 50 is placed downstream the second transfer nip T2 along the paper path 40. The fixing unit 40 includes a heat roller 52 and a facing pressure roller 54. A pair of discharge rollers 56 are disposed downstream the fixing unit 50. The paper path 40 extends from the nip between the feed roller 44 and the retard roller 46 through the second transfer nip T2 and the fixing unit 50 up to the discharge rollers 56.

While the description above has been confined to a tandem engine image forming apparatus, the image forming apparatus of the invention is not limited thereto and may be those employing other systems, for example, a rotary system.

The charging roller 14 mounted on the image forming apparatus 10 and a cleaning roller 100 cleaning the charging roller 14 will be described in greater detail.

Figure 2:
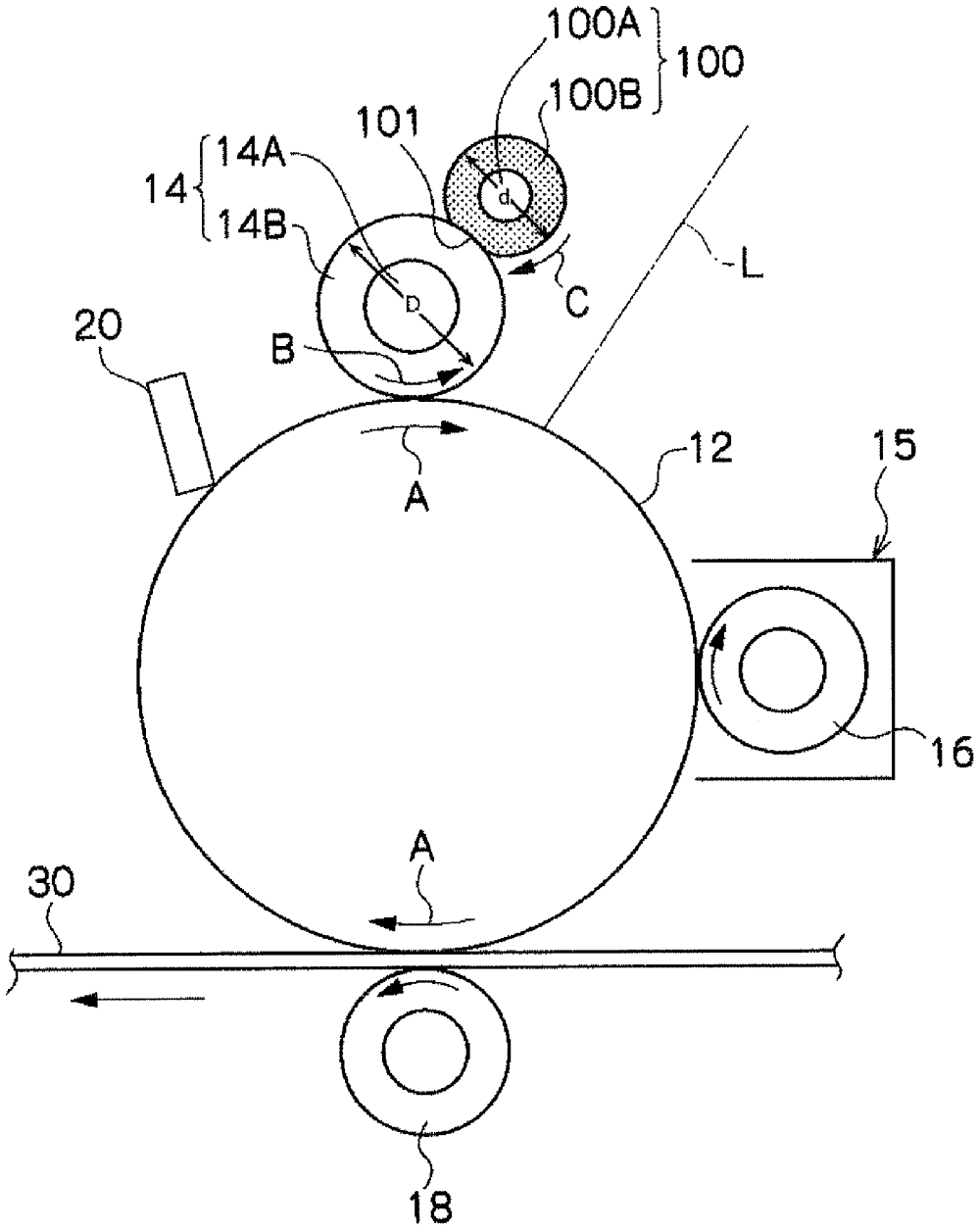
FIG. 2 shows an enlarged view of the photoreceptor drum, charging roller, and cleaning roller mounted on the apparatus of FIG. 1.

As illustrated in FIG. 2, the charging roller 14 is positioned in contact with and immediately above each photoreceptor drum 12. The charging roller 14 is composed of a conductive shaft 14A and a charging layer 14B disposed around the shaft 14A. The shaft 14A is rotatably supported. Positioned in contact with and to the upper right of the charging roller 14 is a cleaning roller 100, which is a cylindrical cleaning member. The cleaning roller 100 is composed of a shaft 100A and an elastic layer (sponge layer) 100B disposed around the shaft 100A. The shaft 100A is rotatably supported.

The cleaning roller 100 is pressed against the charging roller 14 under a predetermined load so that the elastic layer 100B is elastically deformed along the nip formed with the charging roller 14 to provide a contact area 101. The photoreceptor drum 12 is rotatably driven by an unshown motor in the direction of arrow A in FIG. 2, i.e., clockwise direction. Driven by the rotation of the charging roller 14, the cleaning roller 100 counterrotates in the direction of arrow C (i.e., counterclockwise direction).

The charging roller 14 and the cleaning roller 100 used in the present embodiment will be described in still greater detail.

As stated above, the charging roller is positioned in contact with the photoreceptor drum 12. A DC voltage or an AC/DC superposition voltage is applied to the charging roller thereby to charge the surface of the photoreceptor drum 12. The charging roller 14 shown in FIG. 2 has a solid cylindrical shape having a core providing a shaft 14A and an elastic layer providing a charging layer 14B. The charging layer 14B may have a layered structure composed of an outer resistive layer and an inner elastic layer supporting the resistive layer. If desired, a protective layer may be provided outside the resistive layer to impart durability and stain resistance to the charging roller 14.

A charging roller including a core, an elastic layer, a resistive layer, and a protective layer will further be described.

Any conductive material may be used to make the core. Materials generally used to make the core include iron, copper, brass, stainless steel, aluminum, and nickel. Materials other than metal may be useful as long as conductivity and moderate rigidity are secured, including resin molded parts having conductive particles dispersed therein and ceramics. The charging roller may have the shape of a hollow cylinder.

The elastic layer is made of a conductive or semiconductive material, generally preferably a resin or rubber material having conductive or semiconductive particles dispersed therein. Examples of suitable resin materials include synthetic resins, such as polyester resins, acrylic resins, melamine resins, epoxy resins, urethane resins, silicone resins, urea resins, and polyamide resins. Examples of suitable rubber materials include ethylene-propylene rubber, polybutadiene, natural rubber, polyisobutylene, chloroprene rubber, silicone rubber, urethane rubber, epichlorohydrin rubber, fluorosilicone rubber, ethylene oxide rubber, and foams obtained therefrom.

Examples of the conductive or semiconductive particles include carbon black; metals, such as zinc, aluminum, copper, iron, nickel, chromium, and titanium; metal oxides, such as $ZnO—Al_2O_3$, $SnO_2—Sb_2O_3$, $In_2O_3—SnO_2$, $ZnO—TiO_2$, $MgO—Al_2O_3$, $Fe—O—TiO_2$, $TiO_2$, $SnO_2$, $Sb_2O_3$, $In_2O_3$, ZnO, and MgO, and ionic compounds, such as quaternary ammonium salts. These materials may be used either alone or in combination of two or more thereof. Where needed, the elastic layer may further contain one or more of inorganic fillers, such as talc, alumina, and silica, and organic fillers, such as powdered fluororesins and powdered silicone rubber.

The resistive layer and the protective layer are preferably made of a binder resin having conductive or semiconductive particles dispersed therein to have a controlled resistance. The resistivity of the resistive layer and the protective layer is preferably $10^3$ to $10^{14}$ Ωcm, more preferably $10^5$ to $10^{12}$ Ωcm, even more preferably 10 to $10^{12}$ Ωcm. With the resistivity falling within the preferred range above, the surface of the photoreceptor is charged more evenly, and occurrence of a local discharge between the charging roller and the photoreceptor, which can cause a white-out or a color spot, is prevented.

The total thickness of the resistive layer and the protective layer is preferably 0.5 to 10 mm, more preferably 1 to 6 mm, even more preferably 2 to 4 mm. With the total thickness being within the preferred range recited, the width of contact between the charging roller and the photoreceptor is kept stable to ensure the capability of the driven charging roller of being driven into rotation and thereby to prevent occurrence of charge unevenness in the direction of rotation.

Examples of suitable binder resins of the resistive layer include acrylic resins, cellulosic resins, polyamide resins, methoxymethylated nylon, ethoxymethylated nylon, polyurethane resins, polycarbonate resins, polyester resins, polyethylene resins, polyvinyl resins, polyarylate resins, polythiophene resins, polyolefin resins, such as PFA, FEP, and PET, styrene-butadiene resins, melamine resins, epoxy resins, urethane resins, silicone resins, and urea resins.

The protective layer is provided for the purpose of, for example, preventing contamination with extraneous matter, such as a toner. The material of the protective layer may be a resin, rubber, and the like, including polyesters, polyimides, copolymer nylons, silicone resins, acrylic resins, polyvinyl butyral, ethylene tetrafluoroethylene copolymers, melamine resins, fluororubbers, epoxy resins, polycarbonate, polyvinyl alcohol, cellulose, polyvinylidene chloride, polyvinyl chloride, polyethylene, and ethylene vinyl acetate copolymers.

Preferred of them are polyvinylidene fluoride, tetrafluoroethylene copolymers, polyesters, polyimides, and copolymer nylons in view of their resistance to contamination with external additives. The copolymer nylons comprise at least one of nylon 610, nylon 11, and nylon 12 as a monomer unit. Comonomer units that may be used in the copolymer nylons include nylon 6 and nylon 66. The total copolymerization ratio of nylon 610, nylon 11, and nylon 12 is preferably 10% or more by weight. Using a copolymer nylon comprising 10% by weight or more of the recited monomer units provides the following advantages: ease of preparing a coating composition; good film forming properties of the coating composition when applied to form a surface layer; and, in particular, reductions of wear of the resin layer with repeated use and of adhesion of extraneous matter to the resin layer; whereby the resulting charging roller exhibits high durability and resistance to variation of characteristics due to environmental changes.

The thickness of the protective layer is preferably 0.01 to 1,000 μm, more preferably 0.1 to 500 μm, even more preferably 0.5 to 100 μm. The protective layer with the preferred thickness above assures stable surface conditions of the charging roller with time, thereby preventing occurrence of image defects due to cracking.

Similarly to those used in the elastic layer, the conductive or semiconductive particles that may be used in the resistive layer and the protective layer include carbon black, metals, metal oxides, and ionic compounds exhibiting ion conductivity, such as quaternary ammonium salts, and combinations thereof. If desired, the resistive layer and the protective layer may further contain one or more additives including antioxidants, such as hindered phenols and hindered amines; inorganic fillers, such as clay, kaolin, talc, silica, and alumina; organic fillers, such as fluororesins and silicone resins; and lubricants, such as silicone oils. Where necessary, the resistive layer and the protective layer may further contain a surfactant, a charge control agent, and the like.

Methods of forming the above described layers include blade coating, Meyer bar coating, spraying, dipping, bead coating, air knife coating, and curtain coating.

The cleaning roller 100 shown in FIG. 2 is composed of a core forming the shaft 100A and a porous elastic layer forming the elastic layer 100B that is provided on the peripheral surface of the core. As previously described, the cleaning roller 100 is disposed in contact with the surface of the charging roller 14.

The material of the core of the cleaning roller 100 should have rigidity enough to support the elastic layer and to maintain the contact with the charging roller 14 under a moderate pressing force. Generally used materials include metals, such as iron, copper, brass, stainless steel, aluminum, and nickel, resin molded parts, ceramics, and resin molded parts and ceramics having dispersed therein conductive particles or inorganic filler particles. The core may be either solid or hollow. The core may preferably be plated for corrosion control.

The porous elastic layer is a generally cylindrical sponge having a prescribed cell density. Examples of useful sponges include ether urethane foams, polyethylene foams, polyolefin foams, melamine foams, and micropolymers. Polyurethane foams are preferred.

Briefly describing preparation of the porous elastic layer taking polyurethane foam as an example, polyurethane foam is produced from a polyol, an isocyanate, a solvent (e.g., water), a catalyst (e.g., an amine catalyst or a metal catalyst), and a foam stabilizer (e.g., a surfactant). For some uses, additives, such as pigments, may also be used in combination. These raw materials are mixed and stirred to cause a chemical reaction, resulting in the formation of a cellular urethane resin. For the details, reference may be made to JP-A-2009-156995 paras. 0029-0044.

The porous elastic layer as the elastic layer of the cleaning roller preferably has a cell number (cell count) of 10 to 100 cells/25 mm, more preferably 30 to 85 cells/25 mm, even more preferably 45 to 75 cells/25 mm. With the cell number falling in the range recited, the cleaning roller easily catches extraneous materials excessively adhering to the charging roller, such as toner particles and external additives, into the cells of its porous elastic layer and easily makes the caught extraneous materials aggregate into lumps great enough to be re-transferred to the photoreceptor via the charging roller. That is, the recited cell number is preferred from the viewpoint of control of accumulation of extraneous matter on the charging roller.

The cell number is determined by counting the number of cells per unit length on a cross-sectional micrograph of a foam.

The elastic layer of the cleaning roller is preferably formed of a foam (i.e., a sponge or a porous body) having a foam hardness of about 200 N to about 400 N. With a foam hardness of about 200 N or more, the elastic layer is prevented from suffering from excessive strain upon being pressed against the charging roller and thus prevented from losing its resilience. With a foam hardness of about 400 N or less, the elastic layer generates sufficient strain when pressed against the charging roller to provide a sufficient shear diffusive force. The foam hardness of the elastic layer is more preferably about 250 N to about 375 N, even more preferably about 275 N to about 350 N. The foam hardness is determined as follows.

Method of Foam Hardness Determination:

Foam hardness is determined in accordance with the conditions and procedures below based on JIS K6400-2, method D.

Sample size: 309×390×50t (mm)

Compressing tool (indenter): 200 mm diameter disk

Compressing mode: partial compression

Pre-compression: done (75% of the original thickness)

Compression: 25% of the original thickness (re-compression)

A sample is horizontally placed on the tester. The indenter is set on the central part of the sample to apply a load of 4.9 N, and the thickness of the compressed part of the sample is measured to give an original thickness. The load is increased to reduce the thickness to 75% of the original thickness (pre-compression). The load is once removed, and the sample is again compressed to reduce the thickness to 25% of the original thickness. After 20 second compression, the load applied to the sample is measured to give a foam hardness (N).

The porous elastic layer as the elastic layer of the cleaning roller preferably has a cell diameter of 200 to 3,000 μm, more preferably 250 to 900 μm, even more preferably 300 to 600 μm. With the cell diameter falling within the range above, the porous elastic layer shows excellent ability to make the supplied abrasive grains and the release agent and/or the solid lubricant move. This ability will sometimes be referred to as uniformizing ability. As used herein, the term "cell diameter" means an average of the maximum and minimum distances between cell struts. The cell diameter is determined by observing the surface of a sample under, e.g., a laser microscope.

It is preferred for the porous elastic layer to have a density of 10 to 150 kg/m$^3$, more preferably 25 to 125 kg/m$^3$, and even more preferably 40 to 90 kg/m$^3$, in terms of permanent compressive strain.

The density of an elastic layer is determined in accordance with JIS K7222. The density is controllable through an expansion ratio, which is controlled by, for example, adjusting the amount of a blowing agent. The expansion ratio is obtained by dividing the mass of a cylindrical elastic layer as obtained by the volume, specifically, (weight of a cellular elastic layer/volume of the cellular elastic layer).

According to the invention, the abrasive grains and at least one of the release agent and the solid lubricant supplied to the member to be cleaned (preferably a charging roller) move on the surface of the member being cleaned in the axial direction of the cleaning roller by the action of the cleaning roller. The axial direction of the cleaning roller refers to a direction perpendicular to the rotational direction of the member being cleaned.

The abrasive particles and at least one of the release agent and the solid lubricant supplied to the member being cleaned only have to move at least in the axial direction of the cleaning roller. It is not intended to exclude movement of the abrasive particles and at least one of the release agent and the solid lubricant in, for example, the moving direction of the member being cleaned. That is, the case where the abrasive particles and at least one of the release agent and the solid lubricant move only in the rotation direction of the member to be cleaned should be excluded.

Since the abrasive grains and the release agent and/or the solid lubricant move on the surface of the member being cleaned in the axial direction of the cleaning roller, they are uniformly distributed in the axial direction of the cleaning roller. As a result, it is believed that uneven contamination of the member to be cleaned is suppressed during long term use thereby to maintain image quality.

As previously stated, in an area where the abrasive grains and the release agent and/or the solid lubricant are supplied in excess, the cleaning roller catches these extraneous materials into the cells and helps aggregates of the extraneous materials to be re-transferred to the photoreceptor via the charging roller. As a result, it is considered that the charging roller is prevented from reducing its charging function.

Figure 3:
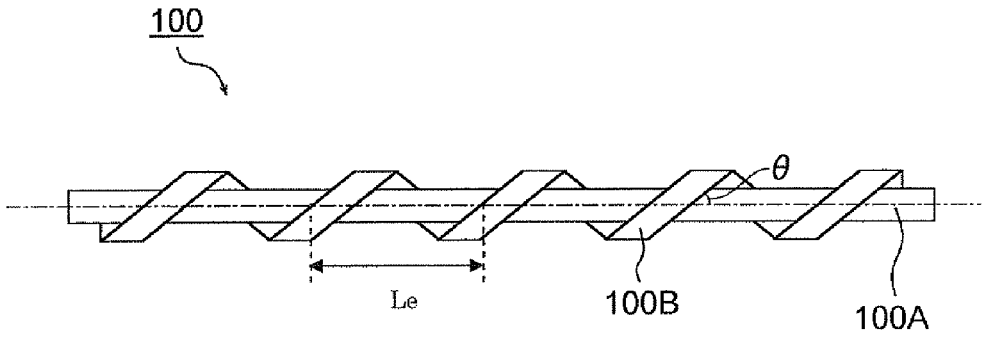
FIG. 3 is a front view of a cleaning roller that may be used in the embodiment shown in FIG. 1.

The cleaning roller 100 of the present embodiment preferably has the elastic layer 100B disposed around the shaft 100A in a helical form as illustrated in FIG. 3. The helical form of the elastic layer ensures the movement of the abrasive grains and the release agent and/or the solid lubricant in the axial direction of the cleaning roller.

The boundary plane defining a boundary between a portion having the elastic layer 100B and a portion having no elastic layer is called "a cut surface". The cut surface preferably makes an angle θ (see FIG. 3) of about 25° to about 75°, more preferably about 35° to about 65°, with the axis of the shaft 100A. This angle will also be referred to as a cut surface angle.

With the angle θ of about 25° or greater, the elastic layer exerts a sufficient shear diffusive force in the longitudinal direction with little diffusive action in the peripheral direction upon release from a compressed state. With the angle θ of about 75° or smaller, there is produced a good shear diffusive force in the longitudinal direction. In short, with the angle θ ranging from about 25° to about 75°, uneven contamination of the charging roller is sufficiently prevented.

Figure 4A:
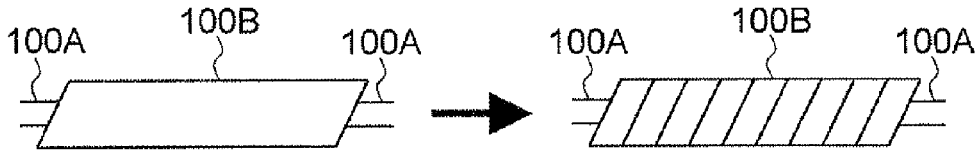
FIG. 4A, FIG. 4B, and FIG. 4C each schematically illustrate a method of forming an elastic layer 100B around a shaft 100A in a helical form.
Figure 4B:
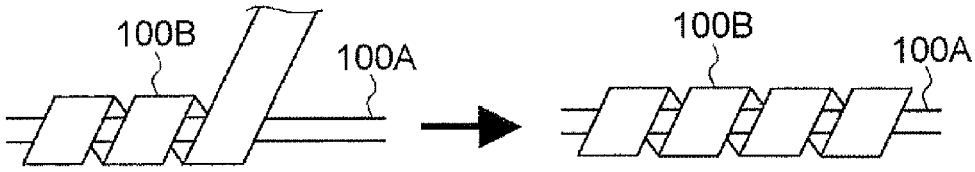
Figure 4C:
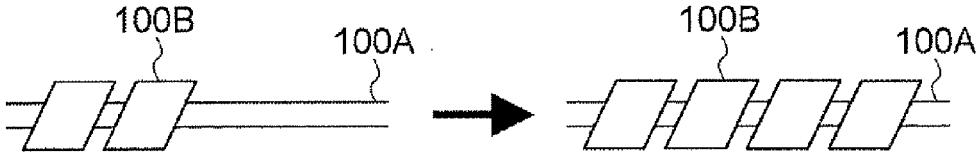

The method for providing the elastic layer 100B around the shaft 100A in a helical form is not particularly limited. FIGS. 4A, 4B, and 4C each schematically represent a method for forming a helical elastic layer 100B on the shaft 100A. FIG. 4A represents a first method including making a plate-shaped foam, such as urethane foam, cutting the foam to a predetermined size, wrapping the cut foam around a core, and polishing and grinding the foam. In this case, the foam around the core is preferably ground to form a helical groove.

FIG. 4B represents a second method including making a plate-shaped foam, cutting the foam into a strip, and winding the strip around a core helically spacedly (to make a groove) around a core to form an elastic layer.

FIG. 40 represents a third method including making a plurality of cylindrical pieces of foam, such as urethane foam, inserting a core through a series of the cylindrical foam pieces to provide an elastic layer. In this case, each cylindrical foam piece is preferably a parallelogram when viewed in a direction perpendicular to the axis of the core. The cylindrical foam pieces are preferably arrayed spacedly to provide a groove therebetween.

The second and third methods are preferred in view of minimized generation of machining dust from the surface of the elastic layer.

FIG. 4A also represents another method which includes producing a cleaning roller having a shaft (core) covered with an in-place expanded polymer and then polishing and grinding the expanded polymer to form a groove. More specifically, a shaft (core) is inserted in the axial center of a cylindrical mold, and a mixture containing a polyol, a polyisocyanate, a polymerization initiator, a blowing agent, and other necessary additives is poured into the mold and heated to cause curing reaction. After cure, the mold is removed. The expansion-molded polymer is polished and partially ground to form a helical groove.

Among these methods preferred is the second method for minimized generation of machining dust and ease of practice.

In the case where the elastic layer has a helical shape, the ratio of the peripheral area of the part of the shaft with the elastic layer formed thereon to the total image-forming area of the shaft that faces the photoreceptor is preferably at least 1/10, more preferably 1/5 or higher, even more preferably 1/3 or higher. That area ratio is preferably 9/10 or lower, more preferably 4/5 or lower, even more preferably 2/3 or lower. With the area ratio falling within the range above, the cleaning roller exhibits excellent ability to uniformize the abrasive grains, release agent, and solid lubricant.

In the case where the elastic layer has a helical shape, the pitch of the helix is preferably 3 to 40 mm, more preferably 5 to 30 mm, even more preferably 10 to 25 mm. As used herein, the term "pitch of the helix" refers to the length Le shown in FIG. 3.

The configuration of the cleaning roller that can be used in the invention is not limited to the structure composed of a core as a shaft 100A and a porous elastic layer 100B formed on the periphery of the core. Any other configuration may be used that allows abrasive grains and at least one of a release agent and a solid lubricant supplied to the charging roller to move on the surface of the charging roller. For example, a cleaning roller composed of a shaft 100A and a nonporous elastic layer of an elastic polymer or a brush type cleaning roller may be used. A cleaning roller having the nonporous elastic layer described or a brush in a helical form is also effective. These and other cleaning rollers may be useful as well provided that the hardness of the elastic layer, the area ratio of the part of the shaft having the elastic layer, and the pitch of the elastic layer are in the respective preferred ranges described above.

Preferred of the above illustrated cleaning rollers are those having a porous elastic layer. It is more preferred for the porous elastic layer be in a helical form.

It is preferred that the curvature radius R of the member to be cleaned and the outermost diameter d of the cleaning roller satisfy relationship (1):

$$1.0R \leqq d \leqq 1.8R \quad (1)$$

When the outermost diameter d of the cleaning roller is 1.0R or greater, the cleaning roller has stable capability of being driven. With the outermost diameter d of the cleaning roller being 1.8R or less, the elastic layer of the cleaning roller is let to exert sufficient shear diffusive force. The outermost diameter d of the cleaning roller is more preferably 1.10R to 1.75R, even more preferably 1.25R to 1.60R.

In the case when the member to be cleaned is circular-cylindrical, it is preferred that the diameter D of the member to be cleaned and the outermost diameter d of the cleaning roller satisfy relationship (2):

$$0.5D \leqq d \leqq 0.9D \quad (2)$$

When the outermost diameter d of the cleaning roller is 0.5D or greater, the frequency of contacts of the elastic layer with the surface to be cleaned of the member being cleaned is prevented from being excessive, resulting in good efficiency of collecting contaminating materials. When the outermost diameter d of the cleaning roller is 0.9D or smaller, the number of rotations necessary for the cut surface of the cleaning roller to contact the whole circumference of the member being cleaning is small so that the contamination unevenness is controlled. As a result, formation of local contamination is controlled to provide improved reliability until an image defect develops.

The outermost diameter d of the cleaning roller is more preferably 0.55D to 0.85D, even more preferably 0.65D to 0.80D.

In the embodiment where the cleaning roller has an elastic layer, the thickness of the elastic layer is preferably 1.5 to 5.0 mm, more preferably 1.8 to 4.5 mm, even more preferably 2.3 to 4.0 mm. With the thickness of the elastic layer of 1.5 mm or greater, the elastic layer is sufficiently deformed when pressed against the charging roller to produce sufficient shear diffusive force. When the thickness is 5.0 mm or smaller, the elastic layer is prevented from being excessively deformed when pressed against the charging roller, whereby deterioration of the elastic layer due to loss of resilience is suppressed.

The amount of deformation of the cleaning roller pressed against the member being cleaned is preferably about 0.2 mm to about 1.2 mm, more preferably about 0.3 mm to about 0.9 mm, even more preferably about 0.4 mm to about 0.7 mm. With that amount of deformation being about 0.2 mm or more, the cleaning roller exhibits good capability of being driven by the member being cleaned, and satisfactory shear diffusive force is obtained. With that amount of deformation being about 1.2 mm or less, since the elastic deformation of the cleaning roller pressed against the member being cleaned is not excessive, deterioration of the elastic layer due to loss of resilience is retarded.

As referred to herein, the term "amount of deformation" denotes a difference between the distance between the member to be cleaned and the cleaning roller in contact with each other without being pressed against each other and the distance between the member to be cleaned and the cleaning roller in their stated pressed against each other in the practice of cleaning operation. When the member to be cleaned is circular-cylindrical, the distance β between the member to be cleaned and the cleaning roller in contact with each other without being pressed against each other is represented by (D+d)/2 (where D: diameter of the member to be cleaned; d: outermost diameter of the cleaning roller). Accordingly, the amount of deformation is represented by (β−α), where α is the distance between the center of rotation of the member being cleaned and the center of rotation of the cleaning roller.

In the invention, abrasive grains and at least one of a release agent and a solid lubricant are supplied to the member to be cleaned. The abrasive grains may be either of a single kind or a mixture of different kinds. The release agent may be either of a single kind or a mixture of different kinds. Understandably, the release agent and the solid lubricant may be used in combination.

The abrasive grains that can be used in the invention are preferably inorganic particles with a Mohs hardness of at least about 5.0, more preferably inorganic particles with a Mohs hardness of about 5.5 or higher, even more preferably inorganic particles with a Mohs hardness about 6.0 or higher. Abrasive grains having a Mohs hardness of about 5.0 or higher help contaminating materials on the member being cleaned to be repositioned through diffusion.

Examples of inorganic particles having a Mohs hardness of 5.0 or higher include silica particles, alumina particles, and titania (titanium oxide) particles. For use in the present embodiment, it is preferred for the abrasive grains to contain at least one of silica particles, alumina particles, and titania particles. It is more preferred that the abrasive grains be selected from the group consisting of silica particles, alumina particles, and titania particles. Silica particles are even more preferred. Rutile type titania is preferred to anatase type because of the higher Mohs hardness of the former.

The abrasive grains preferably have an average length of about 40 to about 500 nm, more preferably about 50 to about 450 nm, even more preferably about 80 to about 300 nm. The advantage is that abrasive grains with an average length of about 40 nm or larger are less adhesive to the surface of the member being cleaned and that those with an average length of about 500 nm or smaller are more capable of catching up the contaminating materials from the member being cleaned and helping them to be repositioned.

In the cases where abrasive grains are supplied as an ingredient of a toner or a developer, those grains with an average length of about 40 nm or larger are easily separated apart from the toner through sliding friction with the cleaning member in a cleaning operation to remove residual toner. As a result, the thus isolated abrasive grains easily slip through the cleaning member and are stably supplied to the member to be cleaned.

The average length of abrasive grains is measured as follows. To monodisperse spherical polystyrene particles having an average particle size of 10 μm are added 3 wt % abrasive grains. The lengths of at least fifty abrasive grains on the polystyrene particles are measured under electron microscopic observation at a magnification of 30,000 times to calculate an arithmetic average, which is taken as an average length of the abrasive grains.

The abrasive grains preferably have an average shape factor SF1 of about 105 to about 155, more preferably about 110 to about 150, even more preferably about 115 to about 145. The advantage is that grains with a shape factor SF1 of about 105 or greater exert sliding friction force effectively and that grains with a shape factor SF1 of about 155 or smaller are less adhesive to the surface of the member being cleaned.

The shape factor SF1 of an abrasive grain is represented by formula:

$$SF1=(ML^2/A)\times(\pi/4)\times 100,$$

where ML is the maximum length (μm) of an abrasive grain; and A is a projected area ($\mu m^2$) of the abrasive grain.

The average shape factor SF1 is obtained using an image analyzer Luzex FT from Nireco Corp. as follows. An optical microscopic image of abrasive grains scattered on a slide glass is scanned into the image analyzer through a video camera. The maximum length (ML) and the projected area (A) of 50 grains are measured to calculate $(ML^2/A)\times(\pi/4)\times 100$ for every grain to obtain an average shape factor SF1.

While the amount of the abrasive grains to be supplied to the charging roller is not particularly limited, the number of abrasive grains to be fed per 100 rotations of a charging roller is preferably 200 to 200,000 grains/$mm^2$, more preferably 500 to 100,000 grains/$mm^2$, even more preferably 1,000 to 60,000 grains/$mm^2$. When supplied in an amount of 200 grains/$mm^2$ or more per 100 rotations of a charging roller, the abrasive grains function to reposition a contaminating substance. When that amount is 200,000 grains/$mm^2$ or less, the abrasive grains are prevented from physically damaging the surface of the charging roller, thereby to minimize reduction of charging function of the charging roller.

The amount of the abrasive grains supplied to a charging roller is determined as follows. A charging roller is operated to carry out image output without a cleaning roller contacted therewith until it completes 100 rotations. After the operation, the abrasive grains adhering to the charging roller is counted under an electron microscope at a magnification of 30,000 times to obtain the number of the grains per $\mu m^2$ of the charging roller surface as an average of ten fields, which is converted to the number per $mm^2$.

The release agent that can be used in the invention is not particularly limited and may be selected as appropriate from those used for electrostatic image developing toners. In particular, the release agent preferably contains at least one member selected from the group consisting of polyethylene wax, paraffin wax, carnauba wax, Fischer-Tropsch wax, and a higher alcohol having 20 to 60 carbon atoms, and is more preferably selected from the group consisting of polyethylene wax, paraffin wax, carnauba wax, Fischer-Tropsch wax, and a higher alcohol having 20 to 60 carbon atoms. Using the above listed release agent improves spreadability of contaminating materials on the member being cleaned to prevent unevenness of contamination. These release agents described may be used either individually or in combination of two or more thereof.

The solid lubricant can be used in the invention is a substance capable of reducing sliding resistance in a solid state unlike the release agent and the like. It is preferred, though not essential, that the solid lubricant contain at least one compound that is selected from the group consisting of polytetrafluoroethylene, a tetrafluoroethylene-containing copolymer, a fluoropolyether, and a perfluoroalkyl-containing compound and has a melt viscosity of about $5.5\times10^3$ Pa·s to about $1.0\times10^7$ Pa·s at 380° C. It is more preferred that the solid lubricant be such a compound or compounds. The solid lubricant whose melt viscosity at 380° C. is about $5.5\times10^3$ Pa·s or higher has a not-too-long molecular chain and easily undergoes shear diffusion by the action of the abrasive grains used in combination. The solid lubricant whose melt viscosity at 380° C. is about $1.0\times10^7$ Pa·s or lower forms a thin film with little variation in thickness on the member being cleaned. The melt viscosity of the solid lubricant at 380° C. is more preferably about $9.0\times10^3$ Pa·s to about $7.0\times10^6$ Pa·s, even more preferably about $5.0\times10^4$ Pa·s to about $5.0\times10^6$ Pa·s.

Using the above described preferred solid lubricant is more effective to prevent uneven distribution of the contaminating substance on the member to be cleaned and also to maintain the properties of the cleaning roller of being driven into rotation.

The viscosity of the solid lubricant at 380° C. is determined with a cone-plate viscometer, specifically E-type Viscometer (a trade name of a cone-plate viscometer manufactured by Tokyo Keiki Inc.) using a cone with a cone angle of 1.34°. The plate (bottom of a sample cup) is connected to a constant temperature, circulating oil bath. The temperature of the oil bath is set at 380° C. An empty sample cup and the cone are mounted and kept at constant temperature by circulating oil. When a steady temperature is reached, a sample weighing one gram is put in the cup and left to stand with the cone kept stationary. After stabilization, the cone is rotated at 60 rpm to take three measurements to obtain an average value.

While the amount of the release agent and/or the solid lubricant to be supplied to the charging roller is not particularly limited, the total amount of the release agent and the solid lubricant is preferably 5 to 90 atomic %, more preferably 25 to 85 atomic %, even more preferably 40 to 75 atomic %, per 100 rotations of the charging roller. With that amount being 5 atomic % or more, the effect of diffusing the contaminating substance is duly produced. With that amount being 90 atomic % or less, the capability of the cleaning roller to be driven are maintained.

The amount of the release agent and/or the solid lubricant to be supplied to the charging roller is determined as follows. A charging roller is operated to carry out image output without a cleaning roller contacted therewith until it completes 100 rotations. After the operation, the surface of the charging roller is analyzed by X-ray photoelectron spectroscopy to detect elements originated in the release agent and/or the solid lubricant. The elemental ratio of the release agent and/or the solid lubricant on the surface of the charging roller is thus obtained.

The method of supplying the abrasive grains and the release agent and/or the solid lubricant to the member to be cleaned, preferably the charging roller, is not particularly limited. For example, these materials may be supplied by placing a molded body of the materials upstream of the member to be cleaned and scraping the molded body with a brush pressed thereagainst, or they may be supplied as ingredients making up a developer. The latter method is advantageous for simplicity of the image forming apparatus.

In the case where the abrasive grains and the release agent and/or the solid lubricant are supplied in the form of a molded body, the molded body is not particularly limited as long as it contains the abrasive grains and at least one of the release agent and the solid lubricant. The content of the abrasive grains in the molded product is preferably 0.5% to 50%, more preferably 1.0% to 35%, even more preferably 2.0% to 25%, by weight, and the total content of the release agent and the solid lubricant in the molded body is preferably 2% to 50%, more preferably 5% to 30%, even more preferably 8% to 20%, by weight.

The molded body may contain additives other than the abrasive grains, the release agent, and the solid lubricant, such as silicone oil, polyester particles, and polystyrene particles. The total content of such additives in the molded body is preferably not more than 10%, more preferably 5% or less, even more preferably 3% or less, by weight.

The molded body may be produced by any method. For example, the abrasive grains, at least one of the release agent and the solid lubricant, and necessary additives are mixed at a temperature at which the release agent and/or the solid lubricant melt. The resulting molten mixture is poured into a mold, followed by cooling to solidify. The solid product is taken out of the mold.

When the abrasive grains and the release agent and/or the solid lubricant are supplied as ingredients of a developer, it is preferred to use a developer containing the abrasive grains as an external additive and a toner comprising toner mother particles containing therein the release agent and/or the solid lubricant. In that case, the amount of the abrasive grains to be added to the toner mother particles is preferably 0.1 to 10 parts, more preferably 0.2 to 8 parts, even more preferably 0.4 to 5 parts, by weight per 100 parts by weight of the toner mother particles. The total content of the release agent and/or the solid lubricant in the toner mother particles is preferably 1 to 20 parts, more preferably 3 to 15 parts, even more preferably 5 to 12 parts, per 100 parts by weight of the toner mother particles.

The developer that may be used in the invention may be either one component developer comprising a toner or a two component developer containing a carrier in addition to the toner.

The toner and the developer that are preferably used in the invention will be described in detail.

The toner preferably has an average shape factor SF1 of 110 to 150. The shape factor SF1 of a particle is represented by formula:

$$SF1=(ML^2/A)\times(\pi/4)\times100,$$

where ML is the maximum length (μm) of a particle; and A is a projected area ($\mu m^2$) of the particle.

The average shape factor SF1 of a toner is obtained as follows. An optical microscopic image of toner particles scattered on a slide glass is scanned into an image analyzer Luzex III from Nireco Corp. through a video camera. The maximum length (ML) and the projected area (A) of randomly chosen 100 particles are measured and substituted into the above formula to calculate their shape factors. The average shape factor SF1 is an average of the results. The average shape factor is a measure of roundness of toner particles. A toner having an average shape factor within the above range will be supplied to the charging roller in an appropriate amount and also exhibits good transfer properties.

The toner preferably has a volume average particle size of 2 to 10 μm, more preferably 3 to 8 μm, even more preferably to 7 μm. A toner whose volume average particle size falls within the range above shows good cleanability from the photoreceptor, exhibits good fluidity, excels in chargeability, minimizes background fog, and provides excellent density reproduction. Furthermore, because such a toner is obtainable with a narrow size distribution, a narrow toner charge distribution is obtained, which affords good reproduction of fine dots and tone.

The toner for use in the invention is not limited by the method of preparation, and any known methods may be used. For example, the toner particles may be produced by a kneading/grinding method in which a binder resin, a coloring agent, a release agent, and necessary additives, such as a charge controlling agent, are blended, kneaded, ground, and classified; a method in which the particles obtained by the kneading/grinding method are subjected to mechanical shock or thermal energy to change the particle shape; an emulsification polymerization/aggregation method in which a monomer of a binder resin is emulsion polymerized, and the resulting dispersion is mixed with dispersions of a coloring agent, a release agent, and other necessary additives, such as a charge controlling agent, to cause the dispersed particles to aggregate, heating the aggregated particles to fuse together into toner particles; a suspension polymerization method in which a monomer providing a binder resin is suspended in an aqueous medium together with solutions of a coloring agent, a release agent, and other necessary additives, such as a charge controlling agent, and polymerized; and an aggregation/coalescence method in which a binder resin, a coloring agent, a release agent, and other necessary additives, such as a charge control agent, are dispersed in an aqueous medium and granulated (aggregated into particles).

The toner particles obtained by any of the above described methods may be further processed into particles having a core/shell structure. That is, aggregated particles are attached to previously prepared aggregated particles and fused together into a core/shell structure. From the viewpoint of shape control and particle size distribution control, the suspension polymerization method, the emulsification polymerization/aggregation method, and the aggregation/coalescence method are preferred, with the aggregation/coalescence method being particularly preferred.

The toner mother particles preferably contain a binder resin, a coloring agent, a release agent, and, if necessary, silica and a charge controlling agent.

Examples of useful binder resins include homo- and copolymers of styrenes (such as styrene and chlorostyrene), monoolefins (such as ethylene, propylene, butylene, and isoprene), vinyl esters (such as vinyl acetate, vinyl propionate, vinyl benzoate, and vinyl butyrate), α-methylene aliphatic monocarboxylic acid esters (such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate), vinyl ethers (such as vinyl methyl ether, vinyl ethyl ether, and vinyl butyl ether), vinyl ketones (such as vinyl methyl ketone, vinyl hexyl ketone, and vinyl isopropenyl ketone); and copolyesters obtained from dicarboxylic acids and diols.

Representative examples of binder resins include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, and polyester resins. Further included in useful binder resins are polyurethanes, epoxy resins, silicone resins, polyamides, modified rosin, and paraffin wax.

Examples of the coloring agent used to make a toner include magnetic powders, such as magnetite and ferrite, carbon black, Aniline Blue, Chalco Oil Blue, Chromium Yellow, Ultramarine Blue, DuPont Oil Red, Quinoline Yellow, Methylene Blue chloride, Phthalocyanine Blue, Malachite Green oxalate, lamp black, Rose Bengal, C.I. Pigment Red 48:1, C.I. Pigment Red 122, C.I. Pigment 57:1, C.I. Pigment Yellow 97, C.I. Pigment Yellow 17, C.I. Pigment Blue 15:1, and C.I. Pigment Blue 15:3.

Examples of typical release agents include low molecular weight polyethylene, low molecular weight polypropylene, Fischer-Tropsch wax, montan wax, carnauba wax, rice wax, and candelilla wax.

Any known charge controlling agents may be used, such as azo metal complex compounds, salicylic acid metal complex compounds, and polar group-containing resin type charge controlling agents. When a toner is produced in a wet process, it is preferred to use materials least soluble in water in terms of ionic intensity control and reduction of waste water pollution. The toner of the invention may be either a magnetic toner containing a magnetic material or a nonmagnetic toner containing no magnetic material.

The toner for use in the invention may be obtained by blending the above described toner mother particles with the above described external additives in a Henschel mixer, a twin-cylinder mixer, or a like device. In the cases where the toner particles are prepared in a wet process, the external addition of the external additives may also be carried out in a wet system.

Lubricant particles may be added to the toner. Examples of useful lubricants include solid lubricants, such as graphite, molybdenum disulfide, talc, fatty acids, and fatty acid metal salts; low molecular weight polyolefins, such as polyethylene, polypropylene, and polybutene; silicones showing a softening temperature when heated; fatty acid amides, such as oleamide, erucamide, ricinolamide, and stearamide; vegetable waxes, such as carnauba wax, rice wax, candelilla wax, Japan wax, and jojoba oil; animal waxes, such as bees wax; mineral or petroleum waxes, such as montan wax, ozokerite, ceresin, paraffin wax, microcrystalline wax, and Fischer-Tropsch wax; and their modified products. These lubricants may be used either individually or as a combination of two or more thereof. The lubricant particles preferably have a volume average particle size of 0.1 to 10 μm. The grains of the above described lubricant may be ground to have a uniform size within the range recited. The amount of the lubricant particles to be added to the toner is preferably 0.05% to 2.0%, more preferably 0.1% to 1.5%, by weight.

For the purpose of removing adhering extraneous substances or deteriorating substances from the surface of the photoreceptor, the toner particles may be combined with inorganic particles, organic particles, or composite particles having organic particles and inorganic particles attached to the organic particles.

The aforementioned abrasive particles are a preferred example of the inorganic particles to be added to the toner. Other examples of suitable inorganic particles include various inorganic oxides, nitrides, boride, and carbides, such as zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The above described inorganic particles may preferably be treated with a titanate coupling agent, a silane coupling agent, or a hydrophobilizing agent. Examples of useful titanate coupling agents include tetrabutyl titanate, tetraoctyl titanate, isopropyltriisostearoyl titanate, isopropyltridecylbenzenesulfonyl titanate, and bis(dioctyl pyrophosphate)oxyacetate titanate. Examples of useful silane coupling agent include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl) γ-aminopropyltrimethyloxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. Examples of hydrophobilizing agent include a silicone oil or a higher fatty acid metal salt, such as aluminum stearate, zinc stearate, or calcium stearate.

Examples of the organic particles to be added to the toner include styrene resin particles, styrene-acrylic resin particles, polyester resin particles, and urethane resin particles.

The inorganic and organic particles preferably have a volume average particle size of 5 to 1,000 nm, more preferably 5 to 800 nm, even more preferably 5 to 700 μm. With that size, the particles are effective in controlling the adhesion between toner particles and thereby ensuring toner fluidity. With that size, the particles are prevented from scratching the surface of the photoreceptor.

The electrophotographic color toner may be used as a blend with a carrier to provide a two component developer. Examples of the carrier include iron powder, glass beads, ferrite powder, and nickel powder, each of which may be resin-coated. A toner to carrier mixing ratio is decided as appropriate.

EXAMPLES

The invention will now be illustrated in greater detail with reference to Examples and Comparative Examples, but it should be understood that the invention is not limited to Examples given hereunder. Unless otherwise noted, all the parts are by weight.

1. Preparation of Toners

Toner mother particles are prepared through the following steps by an emulsification/aggregation method.

1-1. Preparation of Resin Dispersion

| | |
|---|---|
| Styrene | 365 parts |
| n-Butyl acrylate | 35 parts |
| Acrylic acid | 8 parts |
| Dodecanethiol | 24 parts |
| Carbon tetrabromide | 4 parts |

The above compounds are mixed and dissolved. The solution is emulsion polymerized in a flask containing 550 parts of ion exchanged water having dissolved therein 6 parts of a nonionic surfactant (Nonipole 400, from Sanyo Chemical Industries, Ltd.) and 10 parts of an anionic surfactant (Neogen SC, from Daiichi Kogyo Seiyaku Co., Ltd.). To the reaction system is added 50 parts of ion exchanged water having dissolved therein 4 parts of ammonium persulfate while stirring for 15 minutes. After system purging with nitrogen, the contents of the flask are heated up to 72° C. in an oil bath while stirring, at which temperature the emulsion polymerization is continued for an additional 5 hour period. As a result, there is obtained a dispersion of resin particles having an average particle size of 160 nm, a glass transition temperature of 60° C., and a weight average molecular weight (Mw) of 12,500.

1-2. Preparation of Coloring Agent Dispersion

| | |
|---|---|
| Cyan colorant (C.I. Pigment Blue 15:3) | 55 parts |
| Nonionic surfactant (Nonipole 400, from Sanyo Chemical Industries) | 7 parts |
| Ion exchanged water | 240 parts |

The above components are mixed, dissolved, and agitated in a homogenizer (Ultra Turrax, from IKA GmBH) for 10 minutes and then dispersed in Ultimaizer to prepare a dispersion of coloring agent particles having an average particle size of 212 nm.

1-3. Preparation of Release Agent Dispersion

| | |
|---|---|
| Paraffin wax (PolyWax 850, from Toyo Petrolite Co., Ltd.) | 80 parts |
| Anionic surfactant (Neogen R, from Daiichi Seiyaku Kogyo) | 6 parts |
| Ion exchanged water | 250 parts |

The above components are put in a stainless steel round flask, dispersed in a homogenizer (Ultra Turrax, from IKA) for 10 minutes, and then further dispersed in a high-pressure, jet type homogenizer to prepare a dispersion of a release agent having an average particle size of 250 nm.

1-4. Preparation of Cyan Toner Mother Particles

| | |
|---|---|
| Resin dispersion (prepared above) | 230 parts |
| Coloring agent dispersion (prepared above) | 30 parts |
| Release agent dispersion (prepared above) | 30 parts |
| Poly (aluminum hydroxide) (Paho 2S, from Asada Chemical Industry Co., Ltd.) | 0.5 parts |
| Ion exchanged water | 600 parts |

The above components are put in a stainless steel round flask and mixed and dispersed in a homogenizer (Ultra Turrax, from IKA). The contents of the flask are heated up to 50° C. in an oil bath. After the contents are maintained at that temperature for 30 minutes, formation of aggregated particles with a D50 of 4.9 μm is confirmed. The temperature of the oil bath is raised to 56° C., at which the contents of the flask are kept for 1 hour, whereupon the D50 increases to 5.7 μm. To the dispersion containing the aggregates is added 23 parts of the resin dispersion prepared above, and the temperature of the oil bath is again raised to 50° C., at which the contents are maintained for 30 minutes. The resulting dispersion containing the aggregates is adjusted to pH 7.0 by the addition of 1N sodium hydroxide. After the flask is closed, the contents of the flask are heated up to 80° C. while stirring using a magnetic stirrer for 4 hours, followed by cooling. The toner mother particles thus formed are collected by filtration, washed 5 times with ion exchanged water, and lyophilized to give cyan toner mother particles with a volume average particle size of 5.9 μm and an average shape factor SF1 of 134.

1-5. Preparation of Toner 1

To 100 parts of the cyan toner mother particles (above prepared, hereinafter the same) are added 1.0 part of rutile type titanium oxide (particle size: 15 nm; n-decyltrimethoxysilane-treated), 1.7 parts of abrasive agent silica (Mohs hardness: 7; average length: 50 nm; shape factor SF1: 140), and 0.3 parts of paraffin wax particles (powder obtained by lyophilization of the release agent dispersion prepared above; average particle size: 250 nm). The mixture is blended in a Henschel mixture at a peripheral speed of 25 m/sec for 15 minutes and sieved at 45 μm to remove coarse grains. The resulting toner is designated toner 1.

1-6. Preparation of Toner 2

To 100 parts of the cyan toner mother particles are added 1.0 part of rutile type titanium oxide (particle size: 15 nm; n-decyltrimethoxysilane-treated), 2.2 parts of abrasive agent silica (Mohs hardness: 7; average length: 120 nm; shape factor SF1: 110), and 0.2 parts of polytetrafluoroethylene particles (melt viscosity at 380° C.: $2.3\times10^6$ Pa·s; average particle size: 350 nm). The mixture is blended and sieved in the same manner as for toner 1 to give toner 2.

1-7. Preparation Toner 3

To 100 parts of the cyan toner mother particles are added 0.6 parts of silica (particle size: 12 nm; silicone oil-treated), 1.5 parts of rutile type titanium oxide (Mohs hardness: 7.5; average length: 40 nm; shape factor SF1: 154), and 0.5 parts of a powdered higher alcohol (average carbon atom number: 30; average particle size: 8 μm). The mixture is blended and sieved in the same manner as for toner 1 to give toner 3.

1-8. Preparation of Toner 4

To 100 parts of the cyan toner mother particles are added 0.8 parts of silica (particle size: 16 nm; hexamethyldisilazane-treated) and 1.2 parts of anatase type titanium oxide (Mohs hardness: 5.5; average length: 40 nm; shape factor SF1: 128). The mixture is blended and sieved in the same manner as for toner 1 to give toner 4.

1-9. Preparation of Toner 5

To 100 parts of the cyan toner mother particles are added 1.5 parts of rutile type titanium oxide (particle size: 15 nm; n-decyltrimethoxysilane-treated), 1.3 parts of abrasive agent silica (Mohs hardness: 7; average length: 75 nm; shape factor SF1: 106), and 0.1 parts of paraffin wax particles (powder obtained by lyophilization of the release agent dispersion prepared above; average particle size: 250 nm). The mixture is blended and sieved in the same manner as for toner 1 to give toner 5.

1-10. Preparation of Toner 6

To 100 parts of the cyan toner mother particles are added 1.5 parts of rutile type titanium oxide (particle size: 15 nm; n-decyltrimethoxysilane-treated), 2.4 parts of abrasive agent silica (Mohs hardness: 7; average length: 280 nm; shape factor SF1: 106), and 0.5 parts of carnauba wax particles (powder obtained by freeze crushing; average particle size: 3.5 μm). The mixture is blended and sieved in the same manner as for toner 1 to give toner 6.

1-11. Preparation of Toner 7

To 100 parts of the cyan toner mother particles are added 1.9 parts of rutile type titanium oxide (particle size: 20 nm; n-octyltrimethoxysilane-treated), 2.7 parts of abrasive agent silica (Mohs hardness: 7; average length: 450 nm; shape factor SF1: 153), and 1.2 parts of Fischer-Tropsch wax particles (powder obtained by freeze crushing; average particle size: 6.7 μm). The mixture is blended and sieved in the same manner as for toner 1 to give toner 7.

1-12. Preparation of Toner 8

To 100 parts of the cyan toner mother particles are added 1.9 parts of rutile type titanium oxide (particle size: 20 nm; n-octyltrimethoxysilane-treated), 2.0 parts of abrasive agent silica (Mohs hardness: 7; average length: 520 nm; shape factor SF1: 150), and 1.2 parts of Fischer-Tropsch wax particles (powder obtained by freeze crushing; average particle size: 6.7 μm). The mixture is blended and sieved in the same manner as for toner 1 to give toner 8.

1-13. Preparation of Toner 9

To 100 parts of the cyan toner mother particles are added 1.0 part of rutile type titanium oxide (particle size: 15 nm; n-decyltrimethoxysilane-treated), 1.5 parts of abrasive agent silica (Mohs hardness: 7; average length: 450 nm; shape factor SF1: 156), and 0.3 parts of paraffin wax particles (powder obtained by lyophilization of the release agent dispersion above prepared; average particle size: 250 nm). The mixture is blended and sieved in the same manner as for toner 1 to give toner 9.

1-14. Preparation of Toner 10

To 100 parts of the cyan toner mother particles are added 1.0 part of rutile type titanium oxide (particle size: 15 nm; n-decyltrimethoxysilane-treated), 2.0 parts of silicon carbide (Mohs hardness: 9.5; average length: 320 nm; shape factor SF1: 131), and 0.3 parts of paraffin wax particles (powder obtained by lyophilization of the release agent dispersion above prepared; average particle size: 250 nm). The mixture is blended and sieved in the same manner as for toner 1 to give toner 10.

1-15. Preparation of Toner 11

To 100 parts of the cyan toner mother particles are added 1.5 parts of rutile type titanium oxide (particle size: 15 nm; n-decyltrimethoxysilane-treated), 1.0 part of abrasive agent silica (Mohs hardness: 7; average length: 50 nm; shape factor SF1: 140), and 1.0 part of tetrafluoroethylene-perfluoroalkyl vinyl ether copolymer particles (melt viscosity at 380° C.: $9.7\times10^6$ Pa·s; average particle size: 5.5 μm). The mixture is blended and sieved in the same manner as for toner 1 to give toner 11.

1-16. Preparation of Toner 12

To 100 parts of the cyan toner mother particles are added 1.0 part of rutile type titanium oxide (particle size: 15 nm; n-decyltrimethoxysilane-treated), 2.2 parts of abrasive agent silica (Mohs hardness: 7; average length: 120 nm; shape factor SF1: 110), and 0.2 parts of polytetrafluoroethylene particles (melt viscosity at 380° C.: $5.3\times10^6$ Pa·s; average particle size: 310 nm). The mixture is blended and sieved in the same manner as for toner 1 to give toner 12.

1-17. Preparation of Toner 13

To 100 parts of the cyan toner mother particles is added 2.2 parts of zinc oxide (particle size: 36 nm; silicone oil-treated). The mixture is blended and sieved in the same manner as for toner 1 to give toner 13.

1-18. Preparation of Toner 14

To 100 parts of the cyan toner mother particles are added 2.2 parts of zinc oxide (particle size: 36 nm; silicone oil-treated) and 1.0 part of abrasive agent silica (Mobs hardness: 7; average length: 50 nm; shape factor SF1: 140). The mixture is blended and sieved in the same manner as for toner 1 to give toner 14.

1-19. Preparation of Toner 15

To 100 parts of the cyan toner mother particles are added 2.2 parts of zinc oxide (particle size: 36 nm; silicone oil-treated) and 0.2 parts of polytetrafluoroethylene particles (melt viscosity at 380° C.: $2.3\times10^6$ Pa·s; average particle size: 350 nm). The mixture is blended and sieved in the same manner as for toner 1 to give toner 15.

2. Preparation of Carrier

| | |
|---|---|
| Ferrite particles (average particle size: 36 μm) | 100 parts |
| Toluene | 18 parts |
| Styrene/methacrylate copolymer (20/80) | 2 parts |
| Carbon black (R330, from Cabot Corp) | 0.2 parts |

The above components except ferrite particles are stirred with a stirrer for 10 minutes to prepare a coating composition (dispersion). The coating composition and the ferrite particles are put in a vacuum degassing kneader and stirred at 60° C. for 30 minutes. The pressure is reduced for degassing while elevating the temperature up to 95° C. to dry the particles to obtain a resin-coated carrier.

3. Preparation of Developers

Seven parts of toner 1 and 100 parts of the carrier obtained above are blended in a twin cylinder mixer for 25 minutes, followed by sieving at 150 μm to remove agglomerates to give developer 1.

Developers 2 through 12 are prepared in the same manner as for developer 1, except for replacing toner 1 with toners 2 through 15.

4. Making of Charging Roller

A resistive layer is formed of a dispersion of 35 parts of Ketjen black in 100 parts of an acrylonitrile-butadiene copolymer rubber around an 8-mm diameter stainless steel supporting shaft to make a charging roller. The resistive layer has a resistivity of $6.2\times10^8$ Ωcm. The molding conditions for forming the resistive layer are adjusted so that the charging roller may have a curvature radius (R) of 7 mm and that the resistive layer may have a thickness of 3 mm.

5. Making of Elastic Rollers (Cleaning Rollers)

5-1. Making of Cleaning Roller (1)

A cleaning roller, designated cleaning roller (1), is made as follows using open-cell urethane foam having a foam hardness (JIS K6400-2, method D) of 320 N, a density of 70 kg/m$^3$, a cell number of 60 cells/25 mm, and a cell diameter of 420 μm.

The urethane foam is cut into a strip having a 2.5 mm (t) by 10 mm rectangular cross-section. The strip is helically and spacedly wound around a core of SUS303 having an outer diameter of 5.5 mm and a length of 332 mm. The winding starts 5 mm from one end of the core and ends 5 mm from the other end. Cleaning roller (1) thus obtained has an outermost diameter (d) of 10.5 mm (d/R=1.50), a cut surface angle θ of 38°, and a foam hardness of 320 N.

5-2. Making of Cleaning Roller (2)

Cleaning roller (2) is made as follows using open-cell urethane foam having a foam hardness (JIS K6400-2, method D) of 320 N, a density of 70 kg/m$^3$, a cell number of 60 cells/25 mm, and a cell diameter of 420 μm.

The urethane foam is cut into a strip having a 1.6 mm (t) by 10 mm rectangular cross-section. The strip is helically and spacedly wound around a core of SUS303 having an outer diameter of 4.1 mm and a length of 332 mm. The winding starts 5 mm from one end of the core and ends 5 mm from the other end. Cleaning roller (2) has an outermost diameter (d) of 7.3 mm (d/R=1.04) a cut surface angle θ of 38°, and a foam hardness of 320 N.

5-3. Making of Cleaning Roller (3)

Cleaning roller (3) is made as follows using open-cell urethane foam having a foam hardness (JIS K6400-2, method D) of 320 N, a density of 70 kg/m$^3$, a cell number of 60 cells/25 mm, and a cell diameter of 420 μm.

The urethane foam is cut into a strip having a 2.5 mm (t) by 10 mm rectangular cross-section. The strip is helically and spacedly wound around a core of SUS303 having an outer diameter of 7.2 mm and a length of 332 mm. The winding starts 5 mm from one end of the core and ends 5 mm from the other end. Cleaning roller (3) has an outermost diameter (d) of 12.2 mm (d/R=1.74) a cut surface angle θ of 38°, and a foam hardness of 320 N.

5-4. Making of Cleaning Roller (4)

Cleaning roller (4) is made as follows using open-cell urethane foam having a foam hardness (JIS K6400-2, method D) of 390 N, a density of 80 kg/m$^3$, a cell number of 95 cells/25 mm, and a cell diameter of 250 μm.

The urethane foam is cut into a strip having a 1.6 mm (t) by 15 mm rectangular cross-section. The strip is helically and spacedly wound around a core of SUS303 having an outer diameter of 7.3 mm and a length of 332 mm. The winding starts 5 mm from one end of the core and ends 5 mm from the other end. Cleaning roller (4) has an outermost diameter (d) of 10.5 mm (d/R=1.50) a cut surface angle θ of 64°, and a foam hardness of 390 N.

5-5. Making of Cleaning Roller (5)

Cleaning roller (5) is made as follows using open-cell urethane foam having a foam hardness (JIS K6400-2, method D) of 205 N, a density of 30 kg/m$^3$, a cell number of 26 cells/25 mm, and a cell diameter of 972 μm.

The urethane foam is cut into a strip having a 3.2 mm (t) by 15 mm rectangular cross-section. The strip is helically and spacedly wound around a core of SUS303 having an outer diameter of 4.1 mm and a length of 332 mm. The winding starts 5 mm from one end of the core and ends 5 mm from the other end. Cleaning roller (5) has an outermost diameter (d) of 10.5 mm (d/R=1.50), a cut surface angle θ of 64°, and a foam hardness of 205 N.

5-6. Making of Cleaning Roller (6)

Cleaning roller (6) is made as follows using open-cell urethane foam having a foam hardness (JIS K6400-2, method D) of 205 N, a density of 30 kg/m$^3$, a cell number of 26 cells/25 mm, and a cell diameter of 972 μm.

The urethane foam is cut into a strip having a 4.0 mm (t) by 6 mm rectangular cross-section. The strip is helically and spacedly wound around a core of SUS303 having an outer diameter of 2.5 mm and a length of 332 mm. The winding starts 5 mm from one end of the core and ends 5 mm from the other end. Cleaning roller (6) has an outermost diameter (d) of 10.5 mm (d/R=1.50), a cut surface angle θ of 25°, and a foam hardness of 205 N.

5-7. Making of Cleaning Roller (7)

Cleaning roller (7) is made as follows using open-cell urethane foam having a foam hardness (JIS K6400-2, method D) of 390 N, a density of 80 kg/m$^3$, a cell number of 95 cells/25 mm, and a cell diameter of 250 μm.

The urethane foam is cut into a strip having a 4.5 mm (t) by 12 mm rectangular cross-section. The strip is helically and spacedly wound around a core of SUS303 having an outer diameter of 3.6 mm and a length of 332 mm. The winding starts 5 mm from one end of the core and ends 5 mm from the other end. Cleaning roller (7) has an outermost diameter (d) of 12.6 mm (d/R=1.80), a cut surface angle θ of 25°, and a foam hardness of 390 N.

5-8. Making of Cleaning Roller (8)

Cleaning roller (8) is made as follows using open-cell urethane foam having a foam hardness (JIS K6400-2, method D) of 320 N, a density of 70 kg/m$^3$, a cell number of 60 cells/25 mm, and a cell diameter of 420 μm.

The urethane foam is cut into a strip having a 2.5 mm (t) by 16 mm rectangular cross-section. The strip is helically and spacedly wound around a core of SUS303 having an outer diameter of 5.5 mm and a length of 332 mm. The winding starts 5 mm from one end of the core and ends 5 mm from the other end. Cleaning roller (8) has an outermost diameter (d) of 10.5 mm (d/R=1.50), a cut surface angle θ of 24°, and a foam hardness of 320 N.

5-9. Making of Cleaning Roller (9)

Cleaning roller (9) is made as follows using open-cell urethane foam having a foam hardness (JIS K6400-2, method D) of 320 N, a density of 70 kg/m$^3$, a cell number of 60 cells/25 mm, and a cell diameter of 420 μm.

The urethane foam is cut into a strip having a 6.5 mm by 2.5 mm (t) cross-section. The strip is helically and spacedly wound around a core of SUS303 having an outer diameter of 5.5 mm and a length of 332 mm. The winding starts 5 mm from one end of the core and ends 5 mm from the other end. Cleaning roller (9) has an outermost diameter (d) of 10.5 mm (d/R=1.50), a cut surface angle θ of 76°, and a foam hardness of 320 N.

5-10. Making of Cleaning Roller (10)

| | |
|---|---|
| Polyester polyol | 100 parts |
| 4,4'-Dipheylmethane diisocyanate | 30 parts |
| Silicon-containing multipolymer (Mw: 2000; Si content: 70%) | 2 parts |
| 1,4-Butanediol | 1 part |
| Trimethylolpropane | 8 parts |

The polyester polyol, 4,4-diphenylmethane diisocyanate, and silicon-containing multipolymer listed above, each having previously been heated to 40° C., are mixed and vigorously stirred in a stainless steel beaker for 15 minutes while introducing air.

Separately, a circular cylindrical shaft of SUS303 having an outer diameter of 5 mm and a length of 332 mm is prepared. The shaft is set up in the axial center of a cylindrical mold having an inner diameter of 18 mm. To initiate curing reaction, 1,4-butanediol and trimethylolpropane are added to the mixture prepared above while stirring. After stirring for 1 minute, the mixture having started curing reaction is poured into the mold maintained at 150° C. The mold is kept at that temperature for 30 minutes. After completion of cure, the mold is removed to obtain the shaft covered with polyurethane foam. The surface of the polyurethane foam is polished, and a 5 mm wide end portion of the urethane foam is removed from each end. The urethane foam covering the shaft is then ground using a grinder to make a 1 mm wide 2 mm deep helical groove in a pattern shown in FIG. 4A to complete cleaning roller (10). The resulting cleaning roller has an outermost diameter of 10 mm (d/R=1.43). The elastic layer has a thickness of 2.5 mm, a cut surface angle of 35°, and a foam hardness of 350 N.

5-11. Making of Cleaning Roller (11)

| | |
|---|---|
| Polyester polyol | 100 parts |
| 4,4'-Dipheylmethane diisocyanate | 30 parts |
| Silicon-containing multipolymer (Mw: 2000; Si content: 70%) | 2 parts |
| 1,4-Butanediol | 1 part |
| Trimethylolpropane | 8 parts |

The polyester polyol, 4,4-diphenylmethane diisocyanate, and silicon-containing multipolymer listed above, each having previously been heated to 40° C., are mixed and vigorously stirred in a stainless steel beaker for 15 minutes while introducing air.

Separately, a circular cylindrical shaft of SUS303 having an outer diameter of 5 mm and a length of 332 mm is prepared. The shaft is set up in the axial center of a cylindrical mold having an inner diameter of 18 mm. To initiate curing reaction, 1,4-butanediol and trimethylolpropane are added to the mixture prepared above while stirring. After stirring for 1 minute, the mixture having started curing reaction is poured into the mold maintained at 150° C. The mold is kept at that temperature for 30 minutes. After completion of cure, the mold is removed to obtain the shaft covered with polyurethane foam. The surface is polished, and a 5 mm wide end portion of the urethane foam is removed from each end. The urethane foam covering the shaft is then ground using a grinder to make 2 mm wide grooves to expose the shaft at a pitch of 10 mm in a pattern shown in FIG. 4C to complete cleaning roller (11). Each piece of the foam remaining on the shaft is a parallelogram when viewed in a direction perpendicular to the axis of the shaft. The resulting cleaning roller has an outermost diameter of 10 mm (d/R=1.43). The elastic layer has a thickness of 2.5 mm, a cut surface angle of 30°, and a foam hardness of 350 N.

5-12. Making of Cleaning Roller (12)

Cleaning roller (12) is made as follows using open-cell urethane foam having a foam hardness (JIS K6400-2, method D) of 320 N, a density of 70 kg/m$^3$, a cell number of 60 cells/25 mm, and a cell diameter of 420 μm.

The urethane foam is cut into a strip having a 10 mm by 1.1 mm (t) rectangular cross-section. The strip is helically and spacedly wound around a core of SUS303 having an outer diameter of 4.5 mm and a length of 332 mm. The winding starts 5 mm from one end of the core and ends 5 mm from the other end. Cleaning roller (12) has an outermost diameter (d) of 6.7 mm (d/R=0.96), a cut surface angle of 38° and a foam hardness of 320N.

5-13. Making of Cleaning Roller (13)

Cleaning roller (13) is made as follows using open-cell urethane foam having a foam hardness (JIS K6400-2, method D) of 320 N, a density of 70 kg/m$^3$, a cell number of 60 cells/25 mm, and a cell diameter of 420 μm.

The urethane foam is cut into a strip having a 10 mm by 2.5 mm (t) rectangular cross-section. The strip is helically and spacedly wound around a core of SUS303 having an outer diameter of 7.8 mm and a length of 332 mm. The winding starts 5 mm from one end of the core and ends 5 mm from the other end. Cleaning roller (13) has an outermost diameter (d) of 12.8 mm (d/R=1.83), a cut surface angle of 38°, and a foam hardness of 320N.

5-14. Making of Cleaning Roller (14)

Cleaning roller (14) is made as follows using open-cell urethane foam having a foam hardness (JIS K6400-2, method D) of 190 N, a density of 70 kg/m$^3$, a cell number of 50 cells/25 mm, and a cell diameter of 480 μm.

The urethane foam is cut into a strip having a 10 mm by 2.5 (t) rectangular cross-section. The strip is helically and spacedly wound around a core of SUS303 having an outer diameter of 5.5 mm and a length of 332 mm. The winding starts 5 mm from one end of the core and ends 5 mm from the other end. Cleaning roller (14) has an outermost diameter (d) of 10.5 mm (d/R=1.50), a cut surface angle of 38°, and a foam hardness of 190 N.

5-13. Making of Cleaning Roller (15)

Cleaning roller (15) is made as follows using open-cell urethane foam having a foam hardness (JIS K6400-2, method D) of 415 N, a density of 140 kg/m$^3$, a cell number of 60 cells/25 mm, and a cell diameter of 420 μm.

The urethane foam is cut into a strip having a 10 mm by 1.6 mm (t) rectangular cross-section. The strip is helically and spacedly wound around a core of SUS303 having an outer diameter of 4.1 mm and a length of 332 mm. The winding starts 5 mm from one end of the core and ends 5 mm from the other end. Cleaning roller (15) has an outermost diameter (d) of 7.3 mm (d/R=1.04), a cut surface angle of 38°, and a foam hardness of 415 N.

6. Making of Molded Release Agent Article (1) and Release Agent Supplying Assembly (1) (for Use in Example 4)

A low density polyethylene (density: 0.92; melting temperature: 102° C.) as a release agent is heated at 120° C. in a mold having inner dimensions of 5×3 (t)×320 mm for 40 minutes, followed by cooling to 25° C. to solidify. The molded release agent taken out of the mold is bonded to a 6 mm wide, 320 mm long SUS plate to make a molded release agent article (1).

A brush having 7 mm long bristles of 15 denier nylon is slidably rotatably combined with the resulting molded release agent article at a position providing a bristles bite of 2 mm into the molded release agent. There is obtained release agent supplying assembly (1).

7. Image Forming Apparatus

A commercially available image forming apparatus (DocuCentre-III 03300, from Fuji Xerox Co., Ltd.) is modified to have the charging unit of its cyan station fitted for the configuration of a charging roller and a cleaning roller as designed in each of Examples and Comparative Examples. An image output test is carried out using the modified image forming apparatus.

In Examples and Comparative Examples, a toner, a developer, and a cleaning roller are combined as shown in Tables 1 and 2 below, and the charging roller and the cleaning roller are positioned so that the cleaning roller may have the amount of deformation shown in Tables 1 and 2.

8. Image Formation Running Test

The modified image forming apparatus is set to provide cyan monochrome output. Eighty copies of an A4 landscape test original having Japanese text printed thereon (image density: 5%) and twenty copies of an A4 landscape test original having a 2 cm by 10 cm solid image printed on the center thereof are obtained alternately until 80,000 copies are outputted in total. An A3 size original having a halftone image (150 dots per inch) printed all over is outputted every thousand copies of the test originals. The running test is carried out in a 20° C. and 55% RH environment. The resulting copies are evaluated for image quality uniformity to examine influences of the cleaning roller configuration and the extraneous materials supplied to the cleaning roller on contamination of the charging roller. The image quality is rated according to the following scale.

AA: Copies of the test originals have no image defects. The halftone outputs have neither density unevenness nor image defects.

A: Copies of the test originals have no image defects. The halftone outputs have slight perceptible density unevenness within a density difference of 0.15 but have no image defects, such as streaks or color dots.

B: Copies of the test originals have no image defects. The halftone outputs have perceptible density unevenness with a density difference of 0.15 to 0.30 but have no image defects, such as streaks or color dots.

C: An image defect develops in the copies of the test originals, and/or appreciable density unevenness with a density difference of more than 0.30 or an image defect, such as a streak or a color dot, develops in the halftone outputs.

The results of evaluation are shown in Tables 1 and 2, in which PTFE stands for polytetrafluoroethylene, LDPE stands for low density polyethylene, and PFA stands for tetrafluoroethylene-perfluoroalkyl vinyl ether copolymer.

TABLE 1

| | | | Configuration of Cleaning Rollers | | | | | | | Image Qualities | |
|---|---|---|---|---|---|---|---|---|---|---|---|
| | | | Cut | | Elastic | | | | | | |
| Example No. | Developer (Toner) | Cleaning Roller | Surface Angle θ (°) | Outermost Diameter d (mm); d/R | Layer Thickness (mm) | Foam Hardness (N) | Amount of Deformation (mm) | Abrasive Grains; Average Length/SF1 | Release Agent and/or Solid Lubricant | After 40,000 Copies | After 80,000 Copies |
| 1 | 1 | 1 | 38 | 10.5; 1.50 | 2.5 | 320 | 0.7 | silica; 50 nm/140 | paraffin wax | AA | AA |
| 2 | 2 | 2 | 38 | 7.3; 1/04 | 1.6 | 320 | 0.7 | silica; 120 nm/110 | PTFE | AA | AA |
| 3 | 3 | 3 | 38 | 12.2; 1.74 | 2.5 | 320 | 0.7 | rutile $TiO_2$; 40 nm/154 | higher alcohol (n = 30) | AA | A |
| 4 | 4 | 4 | 64 | 10.5; 1.50 | 1.6 | 390 | 0.2 | anatase $TiO_2$; 40 nm/128 | LDPE (release agent supplying assembly 1) | A | B |
| 5 | 5 | 5 | 64 | 10.5; 1.50 | 3.2 | 205 | 1.2 | silica; 75 nm/106 | paraffin wax | AA | B |
| 6 | 6 | 6 | 25 | 10.5; 1.50 | 4 | 205 | 0.2 | silica; 280 nm/106 | carnauba wax | AA | A |
| 7 | 7 | 7 | 25 | 12.6; 1.80 | 4.5 | 390 | 1.2 | silica; 450 nm/153 | Fischer-Tropsch wax | AA | A |
| 8 | 1 | 8 | 24 | 10.5; 1.50 | 2.5 | 320 | 0.7 | silica; 50 nm/140 | paraffin wax | B | B |
| 9 | 2 | 9 | 76 | 10.5; 1.50 | 2.5 | 320 | 0.7 | silica; 120 nm/110 | PTFE | B | B |
| 10 | 1 | 10 | 35 | 10.0; 1.43 | 2.5 | 350 | 0.6 | silica; 50 nm/140 | paraffin wax | A | A |
| 11 | 2 | 11 | 30 | 10.0; 1.43 | 2.5 | 350 | 0.4 | silica; 120 nm/110 | PTFE | AA | AA |
| 12 | 1 | 12 | 38 | 6.7; 0.96 | 1.1 | 320 | 0.4 | silica; 50 nm/140 | paraffin wax | B | B |
| 13 | 2 | 13 | 38 | 12.8; 1.83 | 2.5 | 320 | 0.7 | silica; 120 nm/110 | PTFE | B | B |
| 14 | 8 | 1 | 38 | 10.5; 1.50 | 2.5 | 320 | 0.7 | silica; 520 nm/150 | Fischer-Tropsch wax | B | B |
| 15 | 9 | 1 | 38 | 10.5; 1.50 | 2.5 | 320 | 0.7 | silica; 450 nm/156 | paraffin wax | B | B |
| 16 | 10 | 1 | 38 | 10.5; 1.50 | 2.5 | 320 | 0.7 | SiC; 320 nm/131 | paraffin wax | B | B |
| 17 | 11 | 1 | 38 | 10.5; 1.50 | 2.5 | 320 | 0.7 | silica; 50 nm/140 | PTFE-PAVE | AA | AA |
| 18 | 12 | 2 | 38 | 7.3; 1.04 | 1.6 | 320 | 0.7 | silica; 120 nm/110 | PTFE | B | B |
| 19 | 1 | 14 | 38 | 10.0; 1.50 | 2.5 | 190 | 0.7 | silica; 50 nm/140 | paraffin wax | B | B |
| 20 | 1 | 15 | 38 | 7.3; 1.04 | 1.6 | 415 | 0.7 | silica; 50 nm/140 | paraffin wax | B | B |
| 21 | 1 | 1 | 38 | 10.5; 1.50 | 2.5 | 320 | 1.3 | silica; 50 nm/140 | paraffin wax | B | B |

TABLE 2

| | | | Configuration of Cleaning Rollers | | | | | | | Image Qualities | |
|---|---|---|---|---|---|---|---|---|---|---|---|
| | | | Cut | | Elastic | | | | | | |
| Comp. Example No. | Developer (Toner) | Cleaning Roller | Surface Angle θ (°) | Outermost Diameter d (mm); d/R | Layer Thickness (mm) | Foam Hardness (N) | Amount of Deformation (mm) | Abrasive Grains; Average Length/SF1 | Release Agent and/or Solid Lubricant | After 40,000 Copies | After 80,000 Copies |
| 1 | 1 | 1 | 38 | | 2.5 | 320 | 0.7 | | | C | C |
| 2 | 1 | 1 | 38 | | 2.5 | 320 | 0.7 | silica; 50 nm/140 | | C | C |
| 3 | 1 | 1 | 38 | | 2.5 | 320 | 0.7 | | PTFE | C | C |

What is claimed is:

1. An image forming apparatus comprising:

a member to be cleaned; and a cleaning roller driven by contact with the member to be cleaned, wherein the image forming apparatus is configured such that abrasive grains and at least one of a release agent and a solid lubricant are supplied to the member to be cleaned and that the supplied abrasive grains and the supplied at least one of a release agent and a solid lubricant move on a surface of the member to be cleaned in an axial direction of the cleaning roller, and the cleaning roller has a plurality of cut surfaces having an angle of about 25° to about 75° with the axial direction of the cleaning roller.

2. The image forming apparatus according to claim 1, wherein the member to be cleaned and the cleaning roller satisfy the following relationship (1):

$$1.0R \leqq d \leqq 1.8R \quad (1)$$

wherein R is a curvature radius of the member to be cleaned at a position in contact with the cleaning roller; and d is an outermost diameter of the cleaning roller.

3. The image forming apparatus according to claim 1, wherein the abrasive grains have a Mohs hardness of about 5 to about 9.

4. The image forming apparatus according to claim 1, wherein the abrasive grains have an average length of about 40 to about 500 nm.

5. The image forming apparatus according to claim 1, wherein the abrasive grains have an average shape factor of about 105 to about 155.

6. The image forming apparatus according to claim 1, wherein the abrasive grains comprise at least one member selected from the group consisting of silica particles, alumina particles, and titania particles.

7. The image forming apparatus according to claim 1, wherein the release agent comprises at least one member selected from the group consisting of: a higher alcohol having 20 to 60 carbon atoms, polyethylene wax, paraffin wax, carnauba wax, and Fischer-Tropsch wax.

8. The image forming apparatus according to claim 1, wherein the solid lubricant comprises at least one compound that is selected from the group consisting of polytetrafluoroethylene, a tetrafluoroethylene-containing copolymer, a fluoropolyether, and a perfluoroalkyl-containing compound, and has a melt viscosity of about $5.5\times10^3$ Pa·s to about $1.0\times10^7$ Pa·s at 380° C.

9. The image forming apparatus according to claim 1, wherein the cleaning roller comprises an elastic layer formed of foam having a foam hardness of about 200 N to about 400 N.

10. The image forming apparatus according to claim 1, wherein the cleaning roller is pressed against the member to be cleaned to be deformed to an amount of deformation ranging from about 0.2 mm to about 1.2 mm.

11. The image forming apparatus according to claim 1, wherein the member to be cleaned is a charging roller.

12. The image forming apparatus according to claim 11, further comprising a cleaning member to remove residual toner, wherein at least one substance selected from the group consisting of the abrasive grains, the release agent and the solid lubricant is supplied as an ingredient of a developer, and part of the supplied substance passes through the cleaning member and is fed to the charging roller.

13. A cleaning apparatus comprising:

a member to be cleaned; and a cleaning roller driven by contact with the member to be cleaned, wherein the cleaning apparatus is configured such that abrasive grains and at least one of a release agent and a solid lubricant are supplied to the member to be cleaned and that the supplied abrasive grains and the supplied at least one of a release agent and a solid lubricant move in a longitudinal direction of the member to be cleaned, and the cleaning roller has a plurality of cut surfaces having an angle of about 25° to about 75° with the axial direction of the cleaning roller.

14. An image forming method comprising:

charging a surface of an image holding member by a charging unit, exposing the charged surface of the image holding member to light to form an electrostatic latent image, developing the latent image on the image holding member with a developer containing a toner to provide a toner image, transferring the toner image to a recording medium by a transfer unit, and fixing the toner image on the recording medium by a fixing unit, at least one member selected from the group consisting of the image holding member, the charging unit, the transfer unit and the fixing unit being cleaned by the cleaning apparatus according to claim 13.

15. A method of cleaning a member to be cleaned, comprising:

driving a cleaning roller into rotation by contact with the member to be cleaned, the contact being such that the cleaning roller being pressed against the member to be deformed, and sliding the cleaning roller on a surface of the member to be cleaned in the presence of abrasive grains, wherein at least one of a release agent and a solid lubricant such that the abrasive grains and the at least one of a release agent and a solid lubricant move in a longitudinal direction of the member to be cleaned, and the cleaning roller has a plurality of cut surfaces having an angle of about 25° to about 75° with the axial direction of the cleaning roller.

* * * * *